United States Patent [19]

Bullivant

[11] Patent Number: 4,824,292

[45] Date of Patent: Apr. 25, 1989

[54] SUPPORT FOR BUILDING STRUCTURES

[75] Inventor: Roger A. Bullivant, Burton-on-Trent, England

[73] Assignee: Roger Bullivant of Texas, Inc., Grand Prairie, Tex.

[21] Appl. No.: 49,122

[22] Filed: May 12, 1987

[30] Foreign Application Priority Data

May 13, 1986 [GB] United Kingdom ..... 8611598

[51] Int. Cl.[4] ..... E02D 27/00

[52] U.S. Cl. ..... 405/229; 52/743; 405/233

[58] Field of Search ..... 405/229, 233, 243, 249; 52/169.1, 743

[56] References Cited

U.S. PATENT DOCUMENTS

| | | | |
|---|---|---|---|
| 794,971 | 7/1905 | Ericsson | 405/233 |
| 1,954,188 | 4/1934 | Thornley | 405/243 |
| 3,425,175 | 2/1969 | Gerde | 405/229 X |
| 4,494,694 | 1/1985 | Pitt et al. | 405/233 X |

*Primary Examiner*—David H. Corbin

*Attorney, Agent, or Firm*—Richards, Harris, Medlock & Andrews

[57] ABSTRACT

A method of forming a support or foundation for a building structure comprises forming a number of upwardly diverging support members interconnected at their upper ends by making correspondingly shaped holes in the ground on which the structure is to be supported thereafter pouring concrete into the holes and allowing it to set to form the foundation. In certain grounds it may be necessary to extend the support structures by driving piles from their base.

16 Claims, 3 Drawing Sheets

SUPPORT FOR BUILDING STRUCTURES

TECHNICAL FIELD

The present invention concerns supports for building structures, especially but not exclusively domestic dwellings.

BACKGROUND ART

Currently the provision of supports or foundations for relatively small buildings, for example houses, involves numerous and different techniques each of which depends upon the environment in which the building has to be constructed. In certain instances, for example, deep wide trenches have to be dug so that shuttering can be erected on which reinforced concrete footings are formed; in other instances piles have to be driven; in other instances slab floors which may or may not be piled have to be laid; all prior to the actual house erection operation.

DISCLOSURE OF THE INVENTION

According to the present invention there is provided a method of forming a support for a building structure, comprising forming a number of upwardly diverging support members which are interconnected at their upper ends by forming correspondingly shaped holes in the ground in which the structure is to be supported, thereafter pouring concrete into the holes.

Preferably each support member is of inverted pyramid shape having a rectangular cross-section.

Preferably the support member includes also a pile extending downwardly from its lower end.

Preferably the method of forming the hole in which the support member is formed comprises driving an inverted pyramidical steel casing into the ground at the desired location. The steel casing is preferably removed after driving and the hole formed by it is kept open by a temporary casing. It may include an extension from its lower end, the transverse dimensions of the extension being less than those of the casing. The steel casing may be driven with a removable tip thereon which may be removed with the casing after the hole has been formed or alternatively can be left down the hole to form the tip of a pile or pile casing.

Preferably the pile or pile casing is guided by the lower opening through the casing during the pile or pile casing driving operation.

Preferably the pile or pile casing is driven in a plurality of sections.

Preferably the pile driving is terminated when the top of the last driven pile or pile casing section is at a level between the top and bottom of the casing.

Preferably said temporary casing includes a body which may be formed from plastics material and is shaped to fit closely against the sides of the hole. Preferably the sides of the temporary casing continuous with the sides of an adjacent hole are arched in plan.

Preferably said casing may include an inflatable member adapted to occupy at least part of said hole formed by the extension from the casing.

BRIEF DESCRIPTION OF THE DRAWINGS

An embodiment of the present invention will now be described by way of example only with reference to the accompanying drawings, in which.

FIG: 5 shows a side elevation; and

Figure 6:
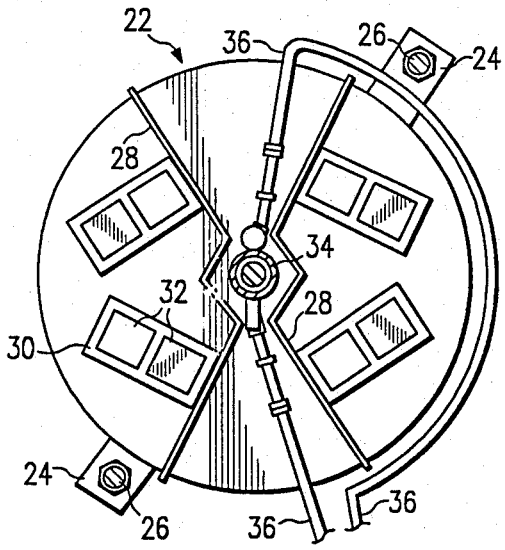

FIG. 6 shows a plan of the anvil member of a pile driving apparatus.

DETAILED DESCRIPTION

The method and apparatus of the present invention has as one of its objects the provision of a simple arrangement for providing a support for a building, which method can be used irrespective of the environment in which the building is being built.

Figure 3:
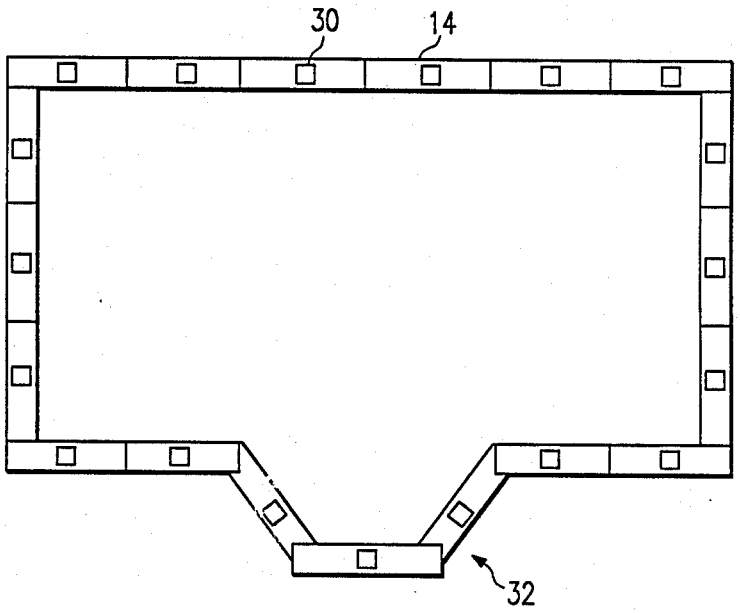
FIG. 3 shows a plan of a support assembly for a building.
Figure 4:
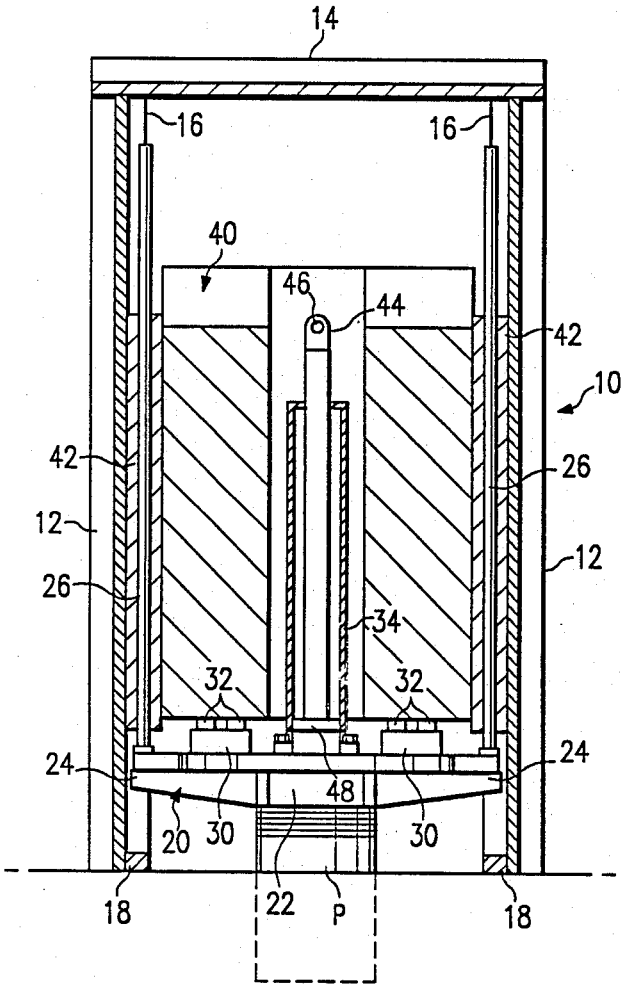
FIG. 4 shows a sectional front elevation of a pile driving apparatus.

A building support may comprise a plurality support columns arranged adjacent to each other in overlapping relationship at their upper ends located in the ground on which load bearing walls of a building will be built. FIG. 3 shows such a building base formed by ground-engaging support columns 14, the Figure showing also how the support columns can be located to support features such as a bay window 32. Ground-engaging support columns (not shown) may also be provided to support interior walls or floor areas.

After the building site has been initially prepared, i.e. by levelling, an operative marks out the site according to a pre-arranged plan by marking out the locations of the centre of each column 14 by, for example, a steel pin.

Specially designed and constructed apparatus is provided for use in forming a pre-formed hole in which the support column can be formed.

The pile driving apparatus comprises essentially a vehicle carrying a pile driving assembly incorporating a large annular mass in the centre of which is located a ram which lifts the mass and allows it to fall onto an anvil which sits on top of a casing to be described below. The apparatus includes also guide means for the anvil and the mass.

To provide a good base for the driving assembly to operate from the ground over which it moves can be temporarily covered by reinforced sheets. These may be arranged around the pins in such a manner that they will provide a centre for the driving assembly.

Figure 1:
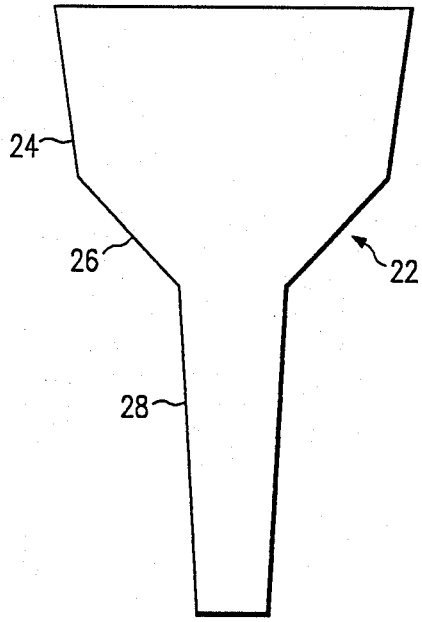
FIG. 1 is a side view of a casing used in the method of the invention.
Figure 2:
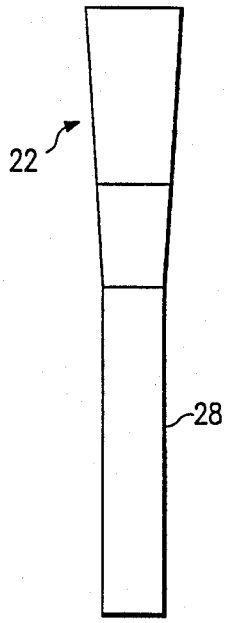
FIG. 2 is an end view of a casing used in the method of the invention.

In the first instance a casing 22 of the type shown diagrammatically in FIGS. 1 and 2 is driven into the ground, centred on the centre of the previously driven steel pin, which is now removed. The casing is rectangular in cross-section and converges downwardly. In side elevation it has a first downwardly converging section 24 which lies at a relatively small angle to the vertical followed by a more steeply angled section 26 leading to an extension 28 whose walls are at a smaller angle to the vertical than the first section. The casing is approximately 2500 mm long and its upper rectangular open area is 1500 mm by 380 mm. The lower open end 30 of the extension is square in cross-section having 152 mm, 203 mm or 254 mm sides.

A removable tip (not shown) is provided on the casing 22 and after fitment of the casing to the anvil of the pile driving assembly and, after careful positioning over the steel pin position, the assembly is operated to force the casing into the ground until its top is at or near ground level.

The casing is then withdrawn from the ground so that the tip may be removed before the casing is replaced in the hole. With the anvil lifted off the casing 22 a square cross-section pile section of a type disclosed in our U.S. Pat. No. 4,735,527 is located in the lower end of the casing guided by the extension 28. The upper end of the pile is located in a guide on the underside of the anvil which has been lowered onto it. A series of pile sections are driven into the ground below the casing until a pile of a predetermined length is driven with the top of the pile located within the casing.

In a modified arrangement it is possible to remove the casing prior to the pile driving operation.

As soon as the pile has been driven the casing 22 is removed and the hole in the ground left by the casing is filled with a temporary casing, which may be formed from fibreglass contoured to fit closely in the hole around the pile top. The ends of the temporary casing may be arcuate. If for any reason the piling has not been carried out before the casing is removed, an inflatable support may be inserted into the lower part of the hole formed by the extension 28 to prevent infill of earth.

When all the holes have been formed and piles driven, the temporary casings are removed and the holes filled with concrete, effectively casing a ring beam (which may be reinforced), in situ.

It will be realised that the method and apparatus of the present invention is applicable for any building irrespective of whether the ground is good, bad, subject to heave, water-logged, etc. Perhaps the only skilled operation is the original setting out and thereafter the method can be carried out virtually continuously by unskilled operatives who bring to the site with them all the materials they require. As the process is effectively continuous there need be no delays awaiting the delivery of ready-mixed concrete, rather this can be delivered at any convenient time after the holes have been formed; the only operation to be carried out immediately prior to concreting being the removal of the temporary casings.

Numerous modifications can be made without departing from the scope of the invention, for example an hydraulic or pneumatic soil displacement mole could be fitted within the casing and allowed to descend into the ground carrying the casing down with it. The mole could also be used to preform an oversized hole in which a hollow upper pile casing could be fitted in ground subjected to heave. In another method of preforming the hole the casing could be forced into the ground by a suitable vibrating assembly supported by a crane mounted on a transport lorry.

In other conditions where the ground is particularly good the pyramidical support column may provide sufficient support and no piles are called for. The casing shown in FIGS. 1 and 2 is especially suitable in these circumstances. When piles are driven the extension 28 may be shorter.

In buildings which are erected on non-level ground the footings or foundations are often stepped, that is they move from one level to another. The method and apparatus of the present invention can readily cope with this by providing special pyramidical casings 22 which form a step. Thus in operation the step in the foundation is formed at the location of one of the steel pegs driven in during the setting out operation and a stepped casing 22 is utilised at this point.

A pile driver of a type suitable for use in driving casings and piles of the type described above forms a second aspect of the present invention.

According to the present invention there is provided a pile driving apparatus comprising a framework, a substantially annular pile driving mass capable of reciprocation relative to the framework, and means for lifting said mass located within the mass and operable to lift the mass and thereafter release it to descend towards the pile to be driven.

Preferably the apparatus is adapted for mounting on a wheeled vehicle. The wheeled vehicle may be a fork-lift truck.

Preferably the means for lifting said mass comprises an hydraluic piston and cylinder device.

Preferably an anvil member is supported on the framework below the annular mass, the anvil member being adapted to rest on a pile being driven and supporting one member of the piston and cylinder of said hydraulic device the other member being fixed to the mass.

Preferably guide means project upwardly from the anvil member and slidably engage guides fixed to the annular mass.

Preferably the guide means comprise a pair of diammetrically opposed rods fixed at their lower ends to the anvil member and passing through passages formed in the guides of the mass. Preferably the guides are of a material having a low coefficient of friction and each has a substantially rectangular external cross-section.

Preferably the framework includes a pair of spaced parallel channel members the openings to the channels facing each other and accommodating guides of the anvil and the annular mass. Preferably end stops are provided to close off the lower end of the channels.

Preferably the uprights are attachable to movable cross-members on the mast of a fork-lift truck.

Preferably replaceable pads are provided on the upper surface of the anvil member against which the mass contacts.

A pile driving apparatus adapted for mounting to the vertically movable cross-members of a fork-lift truck includes a framework 110 comprising two spaced parallel upright members 112 formed from I-beams and connected together at their top by a cross-bar 114. The I-beams are arranged such that they provide open topped channels 116 which face each other and the lower ends of which are closed off by stop members 118.

An anvil member 120 is slidably mounted in the channels 116, the member having two guides 124 which are substantially rectangular in plan projecting therefrom at diammetrically opposed locations, the guides 124 being slidably located in the channels 116. A circular cross-section rod 126 is fixed to and extends upwardly from each guide 124. Deformed plates 128 are fixed to the upper surface of the anvil which also supports four boxes 130 into each of which removable anvil pads 132 can be fitted.

The lower end of a cylinder 134 of an operating piston and cylinder device or ram is bolted to the centre of the circular section 122 of the anvil member 120 and hydraulic feed lines 136 (FIG. 6) are led to the cylinder 134 under the level of the top of the plates 128 and the anvil pads 132.

An annular pile driving mass 140 has square cross-section guides 142 fixed to its sides, the guides being so arranged that each slides in a channel 116. Each guide 142 has a circular through passage to slidingly accommodate a guide rod 126 projecting from the upper surface of the anvil member 120. A piston rod 144 projecting from the cylinder 134 of the ram is fixed by a pin 146 to the mass 140 whereby by introducing hyraulic fluid into the cylinder 134 by means of one of the feed lines 136 a piston 148 attached to the piston 144 is caused to move up the cylinder 134 thereby lifting the mass 140 above the anvil member 120 which, at this stage, is resting on the top of a pile P to be driven. Release of the pressurised supply and simultaneous exhaust of fluid from the cylinder 134 through the other of the lines 136 enables the mass 140 to accelerate downwardly against the pads 132 thereby transmitting a blow to the pile P.

Figure 5:
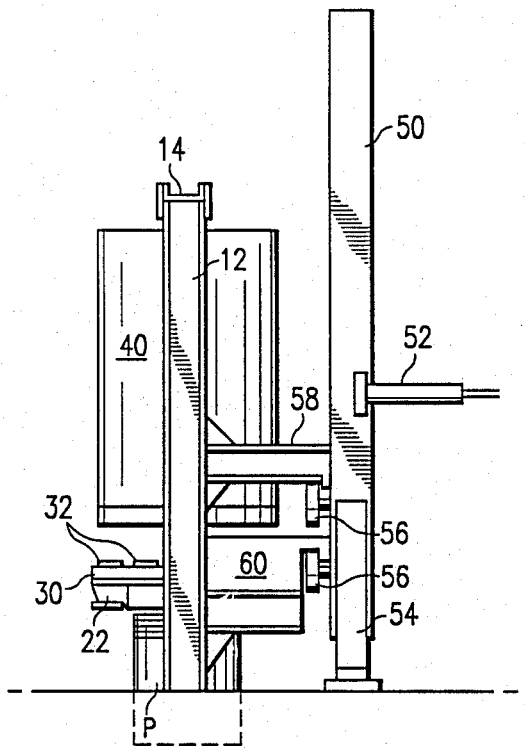

For ease of operation the pile driving arrangement is attached to a fork-lift truck only part of which is shown in FIG. 5. The truck includes a mast 150 having the normal tilt control rams 152, steadying outriggers 154 and vertically movable cross-member 156. Connection members 158, 160 extend rearwardly of the uprights 112 of the frame 110 and are attachable to the cross-members 156 so that to move the pile driving apparatus from one operating position to another it is simply necessary to operate the fork-lift truck lifting rams to move the cross-members 156 up the mast 150 thereby transmitting upward movement by way of the members 158, 160 to the framework 110. This movement is continued until the stops 118 at the lower end of the uprights 112 come into contact with the undersurface of the guide members 124 of the anvil member, thereafter continued upward movement of the cross-member 156 will cause the mass and anvil member to be lifted upwardly with the frame 110.

Various modifications can be made without departing from the scope of the invention, for example the underside of the anvil member 22 can have a number of guide members fitted thereon such that it may accommodate sheet piles, parallel sided tubular piles, solid piles of any appropriate cross-section, and conical pile cap forming cones or mandrels of the type described in my co-pending U.K. patent application No. 8505799.

I claim:

1. A method of forming a continuous footing and support casing foundation for a building comprising:

forming a plurality of abutting connecting holes in the ground surface which holes define a continuous beam of predetermined depth and width, each said hole having a top portion with an upwardly facing multi-sided face with one side of each face being substantially co-extensive with one side of the face of the adjacent hole or overlapping a portion of the rectangular face of the adjacent hole, and filling said holes with concrete to form a foundation structure with a substantially continuous surface exposed footing of predetermined uniform width.

2. The method of claim 1 further comprising forming each hole with a truncated pyramid shape having a rectangular cross-section.

3. The method of claim 1 further comprising forming each hole with a pile forming hole extending downwardly from its lower end.

4. The method of claim 3 further comprising forming each said hole by driving an inverted pyramidal steel casing into the ground at the desired location.

5. The method of claim 4 further comprising driving the steel casing with a removable tip thereon and removing the casing after the hole has been formed.

6. The method of claim 4 further comprising driving the steel casing with a removable tip thereon and leaving the removable tip in the hole to form the tip of a pile or pile casing.

7. The method claim 4 further comprising driving a pile through the lower opening through the casing.

8. The method of claim 7 further comprising terminating the pile driving when the top of the pile is at a level between the top and bottom of the casing.

9. A method of forming a continuous footing and support casing foundation for a building comprising:

forming a plurality of abutting connecting holes in the ground surface, said holes having an upper portion which is upwardly diverging and having an upper face with one side of said face being co-extensive with one side of the face of the adjacent hole or overlapping the face of the adjacent hole, said holes further having a bottom elongated portion extending into the ground below said upper portion, and filling said holes with concrete to form a foundation structure with a substantially continuous surface exposed footing with the elongate portion of each hole extending therebelow.

10. The method of claim 9 further comprising forming each hole with a truncated pyramid shape having a rectangular cross-section.

11. The method of claim 9 further comprising forming each hole with a pile forming hole extending downwardly from its lower end.

12. The method of claim 11 further comprising forming each said hole by driving an inverted pyramidal steel casing into the ground at the desired location.

13. The method of claim 12 further comprising driving the steel casing with a removable tip thereon and removing the casing after the hole has been formed.

14. The method of claim 12 further comprising driving the steel casing with a removable tip thereon and leaving the removable tip in the hole to form the tip of a pile or pile casing.

15. The method of claim 12 further comprising driving a pile through the lower opening through the casing.

16. The method of claim 15 further comprising terminating the pile driving when the top of the pile is at a level between the top and bottom of the casing.

* * * * *